United States Patent [19]

Staebler

[11] 4,008,014

[45] Feb. 15, 1977

[54] PISTON SEALS FOR ROTARY MECHANISMS

[75] Inventor: Paul J. Staebler, Dunlap, Ill.

[73] Assignee: Caterpillar Tractor Co., Peoria, Ill.

[22] Filed: Oct. 23, 1975

[21] Appl. No.: 625,225

[52] U.S. Cl. ..... 418/51; 418/53; 418/123; 418/142

[51] Int. Cl.[2] ..... F01C 1/02; F01C 19/00; F04C 17/02; F04C 27/00

[58] Field of Search ..... 418/49–53, 418/120, 121, 123, 124, 142

[56] References Cited

UNITED STATES PATENTS

| | | | |
|---|---|---|---|
| 3,485,218 | 12/1969 | Clarke | 418/53 |
| 3,491,730 | 1/1970 | Nilsson | 418/123 |
| 3,492,974 | 2/1970 | Kreimeyer | 418/53 |

OTHER PUBLICATIONS

Clarke et al., A New Class of Rotary Piston Machine Suitable for Compressors, Pumps, and Internal Combustion Engines, Proceedings at Institute of Mechanical Engineers, 1972, vol. 186 62/72, pp. 418–453, 743–753.

*Primary Examiner*—John J. Vrablik
*Attorney, Agent, or Firm*—Wegner, Stellman, McCord, Wiles & Wood

[57] ABSTRACT

An improved rotary mechanism including a housing defining an operating chamber, a shaft journalled in the housing and extending through the chamber, and a rotor having plural apices journalled on the shaft and within the chamber. The rotor includes apex seal receiving grooves at its apices and piston seal receiving bores intersecting the grooves. Apex seals are disposed in the apex seal receiving grooves while piston seals are disposed in the bores. Balance pistons are disposed within the bores and abut the associated piston seals adjacent the point of intersection of the bores and the grooves and fluid passages establish fluid communication between the bores and a portion of the rotor surface remote from the corresponding apex to provide for gas energization of the piston seals either by gas pressure directly against the piston seals or indirectly through gas pressure applied to the balance pistons for all cyclic stages of operation of the mechanism.

3 Claims, 3 Drawing Figures

PISTON SEALS FOR ROTARY MECHANISMS

BACKGROUND OF THE INVENTION

This invention relates to rotary mechanisms, and, more particularly, to slant axis rotary mechanisms to be employed as engines, compressors, pumps, or the like.

In slant axis rotary mechanisms, peripheral seals engaging the outer spherical wall of the operating chamber seal well regardless of pressure differentials thereacross. The same is generally true of apex seals.

However, in the case of piston seals (bolts), for certain stages in the cyclic operation of such mechanisms there is no ready path for fluid under pressure to be directed to the under side of the piston seal to assist in biasing the same against the outer spherical wall. Consequently, the opportunity for the existence of an undesirable leakage path at each piston seal at certain points in the operation of such mechanisms exists.

SUMMARY OF THE INVENTION

The principal object of the present invention is to provide a new and improved slant axis rotary mechanism. More specifically, it is an object of the invention to provide such a mechanism with improved means for energizing piston seals thereof by gas during all stages of operation of such a mechanism, regardless of pressure differentials.

An exemplary embodiment of the invention achieves the foregoing object in a rotary mechanism having a housing defining an operating chamber with the shaft journalled in the housing. A rotor having plural apices is journalled on the shaft and within the chamber and includes apex seal receiving grooves at its apices and piston seal receiving bores intersecting the grooves. Apex seals are disposed in the grooves and piston seals are received in the bores. Balance pistons are also disposed within the bores and in abutting relation with the associated piston seals adjacent the point of intersection of the bores and the grooves. Fluid passages establish fluid communication between the bores and a portion of the surface of the rotor remote from the corresponding apex. As a consequence, the piston seals will be biased by gas pressure into sealing engagement with the walls of the chamber either by gas pressure applied directly to the piston seal from gas entering the bore from the associated groove or indirectly by gas entering the bore through the fluid passage to exert a force against the balance piston which, in turn, conveys the force to the piston seal.

In a highly preferred embodiment of the invention, springs are provided in each of the bores for biasing the corresponding balance piston into engagement with the associated piston seal.

Other objects and advantages will become apparent from the following specification taken in connection with the accompanying drawings.

DESCRIPTION OF THE PREFERRED EMBODIMENT

Figure 1:
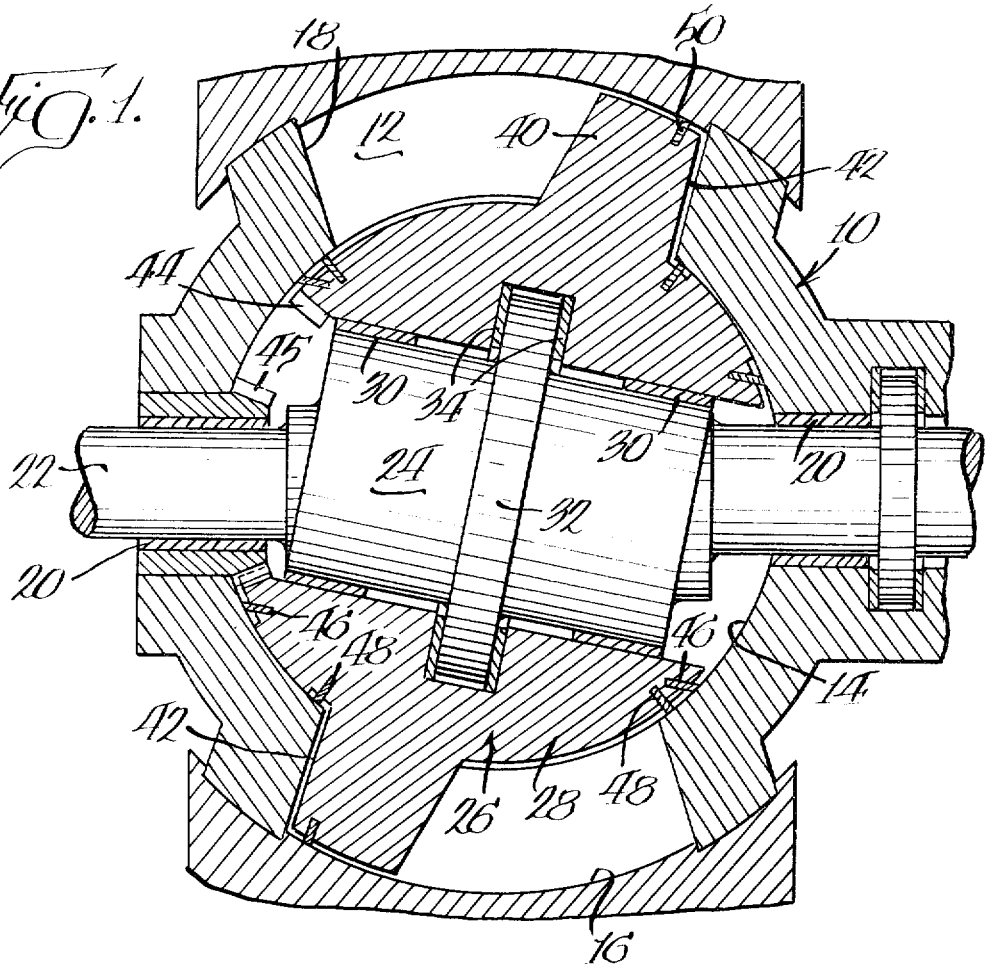
FIG. 1 is a sectional view of a rotary mechanism, specifically, a slant axis rotary mechanism, embodying the invention.

An exemplary embodiment of a rotary mechanism embodying the invention is illustrated in FIG. 1 in the form of a slant axis rotary engine of the four-cycle type. However, it is to be understood that the invention will find utility in rotary mechanisms other than engines, such as pumps, compressors, or the like. It is also to be understood that the invention will find utility in rotary mechanisms other than slant axis rotary mechanisms as, for example, trochoidal mechanisms. Finally, it is to be understood that the invention will find utility in mechanisms operating on other than the four-cycle principle.

An exemplary embodiment of a rotary mechanism embodying the invention includes a housing, generally designated 10, defining a chamber 12, a portion of which acts as an operating cavity, as is well known. The chamber 12 is defined by a radially inner spherical wall 14, a radially outer spherical wall 16, and opposed, generally radially extending, side walls 18 interconnecting the walls 14 and 16.

Bearings 20 journal a shaft 22 such that an angularly offset portion 24 of the shaft is disposed within the chamber 12. A rotor, generally designated 26, has its hub 28 journalled on the angularly offset portion 24 by means of journal bearings 30. A thrust collar 32 and thrust bearings 34 are also provided.

The rotor 26 has a peripheral flange 40, each side of which is provided with plural apices 42. In a four-cycle construction, there will be three apices 42 on each side of the flange as is well known.

The rotor hub 28 includes an internal ring gear 44 which is meshed with a timing gear 45 carried by the housing 10 to establish the proper relative rates of rotation of the shaft 22 and rotor 26.

The hub 28 carries oil seals 46 and compression seals 48 in engagement with the inner spherical wall 14. The flange 40, on its radially outer periphery, carries peripheral seals 50 in sealing engagement with the outer spherical wall 16. In addition, piston seals (sometimes termed "bolts") and apex seals are also carried by the flange 40.

Figure 2:
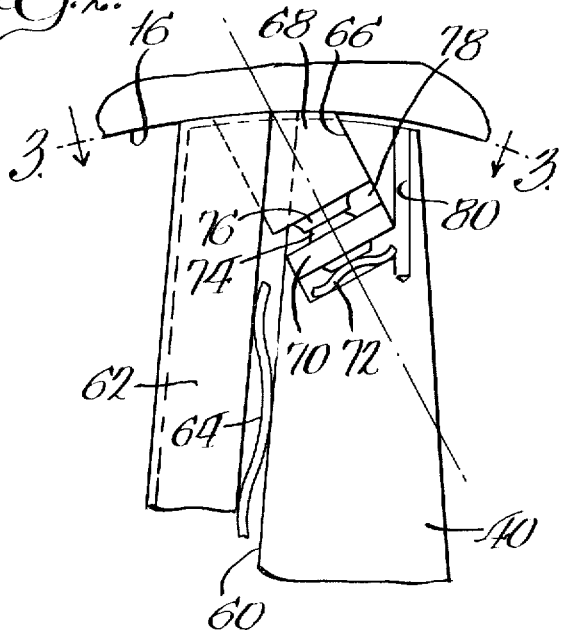
FIG. 2 is an enlarged, fragmentary sectional view taken along the line 2—2 in FIG. 3.
Figure 3:
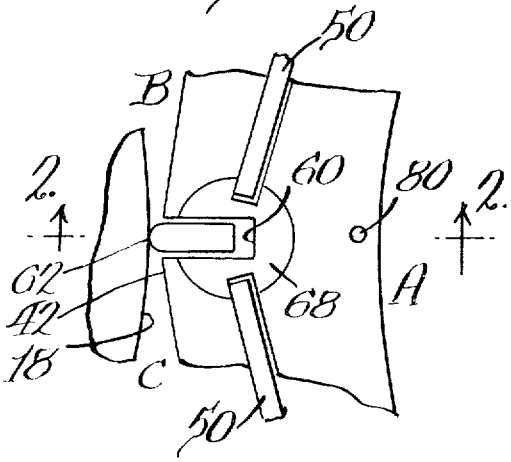
FIG. 3 is a fragmentary developed view of a part of the mechanism.

As best seen in FIGS. 2 and 3, at each apex 42 there is provided a groove 60 for receipt of an apex seal 62 which extends along the length of each apex. A biasing spring 64 is disposed in each of the grooves 60 to bias the apex seal 62 outwardly into engagement and to the corresponding one of the side walls 18.

At the radially outer periphery of the flange 40, there is a radially outwardly opening bore 66 at each apex. Each bore 66, partially along its length, intersects the corresponding apex seal receiving groove 60 as best seen in FIG. 2.

Within each bore 66 there is disposed a conventional piston seal 68 which seals against the outer spherical surface 16. As seen in FIG. 3, the piston seal 68 partially surrounds the apex seal 62 as well as the ends of adjacent peripheral seals 50.

Disposed within each bore 66 below its point of intersection with the corresponding apex seal receiving groove 60 is a balance piston 70 and a biasing spring 72. Each balance piston 70 includes a raised, lesser diameter portion 74 in engagement with a similar reduced diameter portion 76 on the underside of the piston seal 68. As a result, an annular gas receiving space 78 is defined.

A small fluid passage or bore 80 establishes fluid communication between the bottom of the bore 66 and the exterior of the rotor, specifically, to a point on the side of the flange 40 remote from the corresponding apex seal 62. More specifically, as best seen in FIG. 3, the passage 80 emerges from the rotor at a point remote from the apex seal 62 and separated therefrom by the peripheral seals 50.

Gas energization of the piston seals 68 is maintained for all parts of an operational cycle where pressure differentials exist as follows. With reference to FIG. 3, if the pressure in chamber C is higher than the pressure in chamber B, the apex seal 62 will be shifted upwardly (as viewed in FIG. 3) in its groove allowing gas under pressure to enter the groove 60 and flow to the annular space 78 and act directly against the underside of the piston seal 68 to bias the same into sealing engagement with the outer spherical wall 16.

Where the pressure in chamber B is greater than that in chamber C, the same type of action will occur but with the apex seal 62 shifting downwardly as viewed in FIG. 3.

In the situation where the pressure in chamber A is higher than the pressure in either chamber B or C, gas under pressure will be admitted to the bore 66 via the passage 80 to act on the underside of the balance piston 70. By reason of its abutment with the piston seal 68, the gas under pressure will force the piston seal 68 into good sealing engagement with the outer spherical wall 16.

In general, it is preferred to employ biasing springs, as the springs 72, to insure adequate sealing during startup of the mechanism before centrifugal force has developed sufficiently to urge the piston seals outwardly. It is also desirable that the balance pistons have only a small amount of free play. In general, the amount of play will be just enough to accommodate deflections in the structure during operation, manufacturing tolerances, and thermal growth of the parts when the mechanism is employed in a use wherein its temperature changes significantly during operation. As a consequence, the flutter amplitude of the balance piston will be small so that wear will be insignificant.

From the foregoing, it will be appreciated that adequate sealing through gas energization is obtained for all conditions of operation. This is particularly useful in slant axis rotary mechanisms in that compression, combustion, or the like, will occur during operation on both sides of the flange. In such slant axis rotary mechanisms, the invention provides a distinct advantage over the prior art structures in that such structures have no means whereby the piston seals may be gas energized when the pressure on the side of the rotor flange opposite from the corresponding apex seal is greater than the pressure on either side of the apex seal, a situation corresponding to that last described above. What is claimed is:

1. A rotary mechanism for use with a fluid comprising:

a housing defining a chamber;

a shaft journalled in said housing and extending through said chamber;

a rotor having plural apices journalled on said shaft and within said chamber, said rotor including apex seal receiving grooves at its apices and piston seal receiving bores intersecting said grooves;

apex seals disposed in said apex seal receiving grooves;

piston seals received in said bores;

balance pistons within said bores and abutting the associated piston seals adjacent the point of intersection of said bores and said grooves; and fluid passages in said rotor establishing fluid communication with said bores and portions of the surface of said rotor remote from the corresponding apex, the fluid from said passages urging the corresponding balance piston into engagement with the associated piston seal.

2. A rotary mechanism according to claim 1 further including biasing springs in said bores urging the corresponding balance piston into engagement with the associated piston seal.

3. A slant axis rotary mechanism according to claim 1 wherein said rotor has a peripheral flange, said apices being disposed on both sides of said flange, said fluid passages opening to a side of the flange opposite from the associated apex.

* * * * *